US009752547B2

(12) United States Patent
Spjuth et al.

(10) Patent No.: US 9,752,547 B2
(45) Date of Patent: Sep. 5, 2017

(54) ELECTRICAL SYSTEM FOR A VEHICLE WITH START/STOP

(75) Inventors: Oerjan Spjuth, Lindome (SE); Torbjoern Larsson, Goeteborg (SE); Daniel Midholm, Goeteborg (SE); Fredrik Ulmhage, Goeteborg (SE)

(73) Assignee: Volvo Car Corporation, Gothenburg (SE)

( * ) Notice: Subject to any disclaimer, the term of this patent is extended or adjusted under 35 U.S.C. 154(b) by 952 days.

(21) Appl. No.: 13/527,204

(22) Filed: Jun. 19, 2012

(65) Prior Publication Data

US 2012/0330538 A1 Dec. 27, 2012

(30) Foreign Application Priority Data

Jun. 22, 2011 (EP) ..... 11170871

(51) Int. Cl.
*F02N 11/08* (2006.01)

(52) U.S. Cl.
CPC .. *F02N 11/0866* (2013.01); *F02N 2011/0885* (2013.01); *F02N 2011/0888* (2013.01); *F02N 2250/02* (2013.01)

(58) Field of Classification Search
CPC . Y02T 10/7005; Y02T 10/7077; Y02T 10/70; Y02T 10/7066; Y02T 10/642;
(Continued)

(56) References Cited

U.S. PATENT DOCUMENTS 5,397,991 A * 3/1995 Rogers ..... B60L 11/1861 320/125
6,466,024 B1 * 10/2002 Rogers ..... B60L 11/1861 324/427
(Continued)

FOREIGN PATENT DOCUMENTS

CN 101175917 A 5/2008
DE 10248658 A1 * 5/2004 ..... F02N 11/04
(Continued)

OTHER PUBLICATIONS

European Patent Office, Extended Search Report for corresponding European Patent Application No. 11170871.15 mailed Nov. 21, 2011.
(Continued)

*Primary Examiner* — Sizo Vilakazi
(74) *Attorney, Agent, or Firm* — Brooks Kushman P.C.

(57) ABSTRACT

An electrical system for a vehicle having an internal combustion engine with start/stop capability includes a primary battery connectible to an engine starter motor; a secondary battery, an alternator, and an electrical load in parallel with one another and selectively connectible in parallel with the primary battery by a charge switch; in parallel with the secondary battery, a DC/DC converter in series with a third electrical energy source; and a bypass switch operable to selectively bypass the DC/DC converter. The bypass switch allows for selective bypassing the DC/DC converter and charging/discharging of the third electrical energy source during start/stop operation, to ensure a sufficient voltage level over the additional vehicle electrical loads when the internal combustion engine and consequently the alternator are not running.

9 Claims, 2 Drawing Sheets

(58) Field of Classification Search
CPC ..... Y02T 10/7216; Y02T 10/48; B60L 11/14; B60L 11/1868; H02J 7/1423
USPC ..... 123/179.28, 179.3, 179.4; 701/113
See application file for complete search history.

(56) References Cited

U.S. PATENT DOCUMENTS

| | | | | |
|---|---|---|---|---|
| 7,407,025 | B2 | 8/2008 | Urakabe et al. | |
| 7,821,214 | B2 | 10/2010 | Yaguchi | |
| 8,210,145 | B2 | 7/2012 | Handa et al. | |
| 2004/0021443 | A1 | 2/2004 | Johanning | |
| 2004/0112320 | A1* | 6/2004 | Bolz | F02N 11/04 123/179.28 |
| 2005/0267697 | A1 | 12/2005 | Gross et al. | |
| 2006/0048983 | A1 | 3/2006 | Urakabe et al. | |
| 2009/0021200 | A1 | 1/2009 | Yaguchi | |
| 2010/0065344 | A1* | 3/2010 | Collings, III | B60L 3/10 180/2.1 |
| 2011/0095603 | A1* | 4/2011 | Lee | B60L 11/1803 307/10.1 |
| 2012/0104768 | A1* | 5/2012 | Gibson | B60L 1/003 290/36 R |
| 2013/0229049 | A1* | 9/2013 | Larsson | F02N 11/0814 307/9.1 |

FOREIGN PATENT DOCUMENTS

| | | | | |
|---|---|---|---|---|
| DE | 102007026164 | A1 | 12/2008 | |
| DE | EP 2314861 | A1 * | 4/2011 | B60R 16/03 |
| EP | 1575153 | A1 | 9/2005 | |
| EP | 2011710 | A1 | 7/2009 | |
| EP | 2314861 | A1 | 4/2011 | |

OTHER PUBLICATIONS

European Patent Office, Office Action for corresponding European application No. 11170871.5, dated Oct. 6, 2016.

* cited by examiner

ELECTRICAL SYSTEM FOR A VEHICLE WITH START/STOP

CROSS-REFERENCE TO RELATED APPLICATIONS

This application claims foreign priority benefits under 35 U.S.C. §119(a)-(d) to EP 11170871.5, filed Jun. 22, 2011, the disclosure of which is hereby incorporated by reference in its entirety.

TECHNICAL FIELD

The invention relates to motor vehicles having internal combustion engines with start/stop systems, and to an electrical system for such a vehicle.

BACKGROUND

So-called start/stop systems are becoming increasingly common in motor vehicles powered by internal combustion engines. These systems offer improved fuel efficiency, especially during stop-and-go driving in congested traffic areas. This is primarily due to a shut-off of the internal combustion engine when not required to propel the vehicle and a restart thereof once required again.

A consideration with shut-off of the internal combustion engine while various vehicle electrical systems are running is that the voltage of the vehicle electrical systems may drop below battery voltage, accounting also for the voltage drop in the cable harness of the vehicle.

Such a drop in the vehicle electrical system voltage may potentially cause problems for vital electrical systems of the vehicle, e.g. exterior lighting systems and possibly also chassis systems.

To deal with this issue, some known current start/stop solutions incorporate a large main battery, such as a conventional acid-lead battery, and a smaller-size support battery. The support battery in such a known arrangement is arranged to supply the vehicle electrical system during warm-starts of the engine. A warm-start is the restarting of the engine that occurs after a relatively brief shut-down period, as during normal start/stop operation of the vehicle while driving.

However, such a known arrangement suffers from limitations in the case of an increased number of start/stop events, higher timing demands and increased current consumption by various vehicle systems.

SUMMARY

In a first disclosed embodiment, apparatus for a vehicle having an internal combustion engine with start/stop capability comprises a primary battery connectible to an engine starter motor; a secondary battery, an alternator, and an electrical load in parallel with one another and selectively connectible in parallel with the primary battery by a charge switch; in parallel with the secondary battery, a DC/DC converter in series with a third electrical energy source; and a bypass switch operable to selectively bypass the DC/DC converter. The bypass switch allows for selective bypassing the DC/DC converter and charging/discharging of the third electrical energy source in the case where the DC/DC converter is arranged to be a boost (step-up) converter.

In another embodiment, a method of operating a motor vehicle in a start/stop mode is provided. The vehicle has an internal combustion engine and an electrical system including a primary battery selectively connectible to a starter motor for the internal combustion engine via a starter solenoid; a secondary battery, an alternator, and additional vehicle electrical loads arranged in parallel with one another and selectively connectible in parallel with the primary battery via a charge switch; and a DC/DC converter and associated bypass switch in series with the third electrical energy source. The method of operation comprises, when the engine is stopped during a start/stop event, opening the charge switch, opening the bypass switch, and activating the DC/DC converter to boosting voltage. The method further comprises, during a warm-start of the engine after a start/stop event, closing the starter solenoid to supply power to the starter motor, opening the charge switch, opening the bypass switch, and the turning off the DC/DC converter.

BRIEF DESCRIPTION OF THE DRAWINGS

Embodiments of the present invention described herein are recited with particularity in the appended claims. However, other features will become more apparent, and the embodiments may be best understood by referring to the following detailed description in conjunction with the accompanying drawings, in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
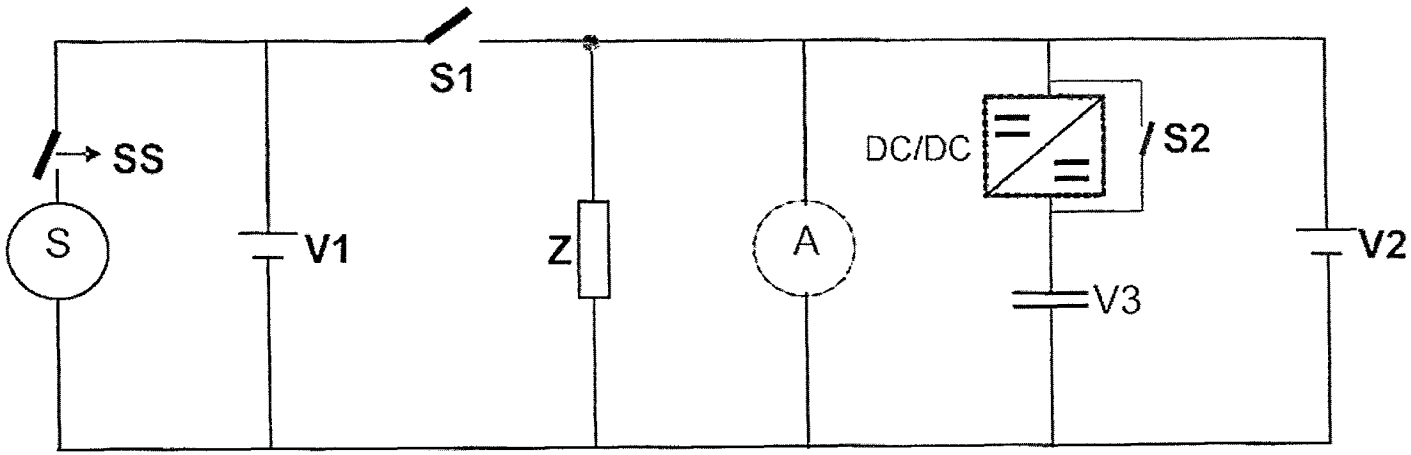
FIG. 2 is a schematic circuit diagram illustrating an arrangement for improving the performance of an electrical system of a vehicle having an internal combustion engine provided with a start/stop system.

In overview, embodiments herein, as shown schematically in FIG. 2, relate to an arrangement for improving the performance of an electrical system of a vehicle having an internal combustion engine provided with a start/stop system.

Figure 1:
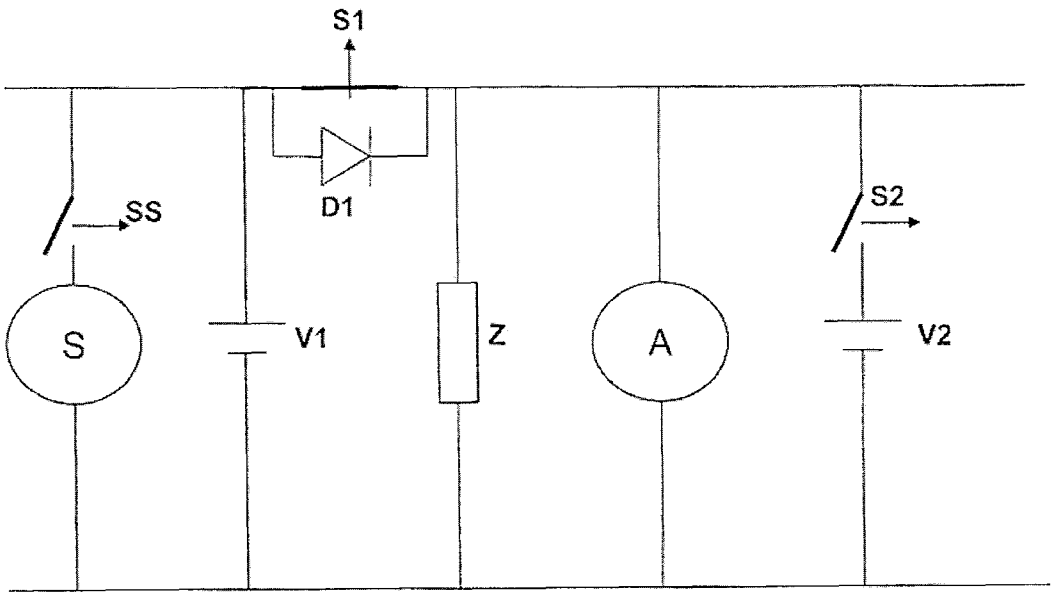
FIG. 1 is a schematic circuit diagram of a prior-art electrical system of a vehicle having an internal combustion engine provided with a start/stop system.

FIG. 1 illustrates a schematic circuit diagram of a prior art electrical system of a vehicle having an internal combustion engine provided with a start/stop system. The electrical system comprises a primary battery V1 which is selectively connectible to a starter motor S for the internal combustion engine via a starter solenoid SS. A secondary battery V2, an alternator A and additional vehicle electrical loads Z are arranged in parallel with each other and are selectively connectible in parallel with the primary battery V1 via a charge switch S1. A diode D1 may be provided in parallel with the charge switch S1 with its anode connected to the side of primary battery V1 and its cathode connected to the side of alternator A. The secondary battery V2 may further be selectively connectible to the alternator A via a secondary charge switch S2.

FIG. 2 illustrates a schematic circuit diagram of an electrical system for a vehicle with a start/stop engine system according to an embodiment of the present invention. The electrical system comprises a primary battery V1 which is selectively connectible to a starter motor S for an internal combustion engine via a starter solenoid SS that opens/closes a switch. A secondary battery V2, an alternator A and one or more additional vehicle electrical loads Z are arranged in parallel with each other and are selectively connectible in parallel with the primary battery V1 by actuation (opening or closing) of a charge switch S1.

In addition thereto, in parallel with the secondary battery, is further arranged a DC/DC converter in series with a third electrical energy source V3.

The DC/DC converter, as will be evident from the following use cases, ensures a sufficient voltage level over the additional vehicle electrical loads Z when the internal combustion engine and consequently the alternator A are not running, thus preventing undesirable drops in the electrical system voltage of the vehicle. The DC/DC converter may be arranged to be a buck-boost (step-up/step-down) converter or only a boost (step-up) converter.

The third electrical energy source V3 may be a super-capacitor and/or a lithium-ion battery. Both the super-capacitor and the lithium-ion battery are suitable for high energy throughput.

A bypass switch S2 is provided for selectively bypassing the DC/DC converter. The bypass switch S2 allows for charging/discharging of the third electrical energy source V3 in the case where the DC/DC converter is arranged to be a boost (step-up) converter.

The arrangement of FIG. 2 also makes it possible to downsize the secondary battery V2, as compared to the prior art solutions, since it is relieved from the large energy cycles previously supported thereby. This also has the result of a longer life expectancy for the secondary battery V2. The secondary battery V2, nevertheless, provides redundancy should an error occur in the circuit comprising the DC/DC converter in series with the third electrical energy source V3 during a start/stop event.

The present disclosure also provides a method for improving the performance of an electrical system of a vehicle having an internal combustion engine provided with a start/stop system. The electrical system further comprises a primary battery V1 which is selectively connectible to a starter motor S for the internal combustion engine via a starter solenoid SS. A secondary battery V2, an alternator A and additional vehicle electrical loads Z are arranged in parallel with each other and selectively connectible in parallel with the primary battery V1 via a charge switch S1. The method comprises the step of arranging in parallel with the secondary battery a DC/DC converter in series with a third electrical energy source V3.

In an embodiment of the method it comprises the further step of arranging as the third electrical energy source V3 a super-capacitor.

In a yet further embodiment of the method it comprises the further step of providing a bypass switch S2 for selectively bypassing the DC/DC converter.

In the following will be described some use cases illustrating use of the arrangement in accordance with the present application.

In a first use case it is assumed that the engine is running and so is driving the alternator A, which is producing electrical current. The charge switch S1 is closed, allowing the starter battery V1 to be recharged. The bypass switch S2 is closed, thus the DC/DC converter is bypassed and third electrical energy source V3 is also recharged by the alternator A. The DC/DC converter is off. The alternator A and the secondary battery V2 in combination supply the additional vehicle electrical loads Z.

In a second use case it is assumed that the starter motor S is running to achieve a cold-start of the internal combustion engine. The charge switch S1 is open, thus only the primary battery V1 supplies the starter motor S. The bypass switch S2 is open. The DC/DC converter is off. Thus, only the secondary battery V2 supplies the additional vehicle electrical loads Z.

In a third use case it is assumed that a start/stop event has occurred, i.e. the internal combustion engine is stopped while at least some of the additional vehicle electrical loads Z are operated. The charge switch S1 is open. The bypass switch S2 is open. The DC/DC converter is boosting to ensure the voltage level over the additional vehicle electrical loads Z. Thus, the third electrical energy source V3 through the DC/DC converter supplies the additional vehicle electrical loads Z. The secondary battery V2 provides for backup in case of an overload or a DC/DC converter fault.

In a fourth use case it is assumed that the starter motor S is running to achieve a warm-start of the internal combustion engine to terminate the start/stop event. The charge switch S1 is open, and thus only the primary battery V1 supplies the starter motor S. The bypass switch S2 is open. The DC/DC converter is boosting to ensure the voltage level over the additional vehicle electrical loads Z. The third electrical energy source V3 through the DC/DC converter supplies the additional vehicle electrical loads Z. The secondary battery V2 provides for backup in case of an overload or a DC/DC fault.

In a fifth use case it is assumed that the vehicle is in a state of long-term parking. The charge switch S1 is open. The bypass switch S2 is open. The DC/DC converter is off. The secondary battery V2 supplies the quiescent current consumption of the additional vehicle electrical loads Z.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for operating an electrical system of a vehicle having an internal combustion engine provided with a start/stop system enabling shutoff of the internal combustion engine while electrical systems of the vehicle are running, the electrical system further comprising a primary battery selectively connectible to a starter motor for the internal combustion engine via a starter solenoid, a secondary battery, an alternator, and additional vehicle electrical loads arranged in parallel with one another and selectively connectible in parallel with the primary battery via a charge switch, the method comprising:

arranging in parallel with the secondary battery a DC/DC converter in series with a third electrical energy source;

and providing a bypass switch for selectively bypassing the DC/DC converter.

2. The method of claim 1, further comprising arranging as the third electrical energy source a super-capacitor.

3. The method of claim 1, further comprising arranging as the third electrical energy source a lithium-ion battery.

4. The method of claim 1, wherein when the engine is stopped during a start/stop event the electrical system is operated such that:

the charge switch is open;

the bypass switch is open; and the DC/DC converter is boosting.

5. The method of claim 1 wherein to achieve a cold-start of the engine the electrical system is operated such that:

the starter solenoid is closed to supply power to the starter motor;

the charge switch is open;

the bypass switch is open; and the DC/DC converter is off.

6. A method of operation of a motor vehicle, the vehicle having an internal combustion engine operable in a start/stop mode enabling shutoff of the internal combustion engine while electrical systems of the vehicle are running, and an electrical system including a primary battery selectively connectible to a starter motor for the internal combustion engine via a starter solenoid; a secondary battery, an alternator, and additional vehicle electrical loads arranged in parallel with one another and selectively connectible in parallel with the primary battery via a charge switch; and, in parallel with the secondary battery, a DC/DC converter and associated bypass switch in series with a third electrical energy source, the method of operation comprising:

when the engine is stopped during a start/stop event:

the charge switch is open, the bypass switch is open, and the DC/DC converter is boosting; and during a warm-start of the engine after a start/stop event:

the starter solenoid is closed to supply power to the starter motor, the charge switch is open, the bypass switch is open, and the DC/DC converter is off.

7. The method of claim 6 further comprising:

during a cold-start of the engine:

the starter solenoid is closed to supply power to the starter motor, the charge switch is open, the bypass switch is open, and the DC/DC converter is off.

8. The method of claim 6 further comprising:

when the engine is running after either a warm-start or a cold-start:

the charge switch is closed, the bypass switch is closed, and the DC/DC converter is off.

9. The method of claim 6 further comprising:

when the vehicle is in a state of long-term parking:

the charge switch is open, the bypass switch is open, and the DC/DC converter is off.

* * * * *